United States Patent [19]

Perry, Jr.

[11] 4,302,661

[45] Nov. 24, 1981

[54] SELF-CLEANING OVEN CONTROL SYSTEM

[76] Inventor: Edward H. Perry, Jr., 2601 Oakland Dr., Cleveland, Tenn. 37311

[21] Appl. No.: 135,768

[22] Filed: Mar. 31, 1980

[51] Int. Cl.[3] ..... H05B 1/02

[52] U.S. Cl. ..... 219/398; 219/414

[58] Field of Search ..... 219/395, 398, 412–414, 219/483, 486, 508

[56] References Cited

U.S. PATENT DOCUMENTS

| | | | |
|---|---|---|---|
| 2,035,767 | 3/1936 | Schulze | 219/398 |
| 2,435,641 | 2/1948 | Weber | 219/414 |
| 2,654,824 | 10/1953 | Schroeder | 219/398 |
| 2,742,558 | 4/1956 | Simmons | 219/398 |
| 2,778,914 | 1/1957 | Vallorani | 219/398 |
| 3,462,583 | 8/1969 | Holtkamp | 219/412 |

FOREIGN PATENT DOCUMENTS

| | | | |
|---|---|---|---|
| 1052595 | 3/1959 | Fed. Rep. of Germany | 219/414 |

*Primary Examiner*—Gene Z. Rubinson
*Assistant Examiner*—Bernard Roskoski
*Attorney, Agent, or Firm*—Bacon & Thomas

[57] ABSTRACT

An electrically heated oven has three heater elements, two of which are used together for broiling. Switches provide for connecting selected heating elements in different parallel, series or series-parallel arrangements to provide different temperature levels and heat distribution for broiling, baking or cleaning, all from a single-voltage power source.

3 Claims, 4 Drawing Figures

"BROIL"

"BAKE"

"SELF CLEAN"

SELF-CLEANING OVEN CONTROL SYSTEM

BACKGROUND OF THE INVENTION

This invention is in the field of electric ovens and particularly self-cleaning ovens.

It is customary in electric ovens to provide for heating the oven to a high temperature for a long period of time for cleaning, in addition to providing heating elements for baking or broiling foods in the oven compartments. Such prior ovens, however, have generally required two different voltage sources for use when cooking foods or for self-cleaning operation and in many instances additional heater elements are employed during the self-cleaning cycle. Such prior arrangements involve additional expense and complication in the arrangement and controls and usually require the application of different voltages to different elements during the various possible cycles of operation.

SUMMARY OF THE INVENTION

The present invention has for its object to provide a self-cleaning oven capable of being used for broiling, baking or self-cleaning, all with a single voltage source and a minimum number of heater elements.

In general, the oven contains broiling and baking heater means, the broiling heater means being a pair of resistance units capable of being connected in different arrangements for different oven functions.

BRIEF DESCRIPTION OF THE DRAWINGS

In the drawings, FIG. 1 schematically illustrates heater elements in an oven connected to a power line for broiling.

DESCRIPTION OF A PREFERRED EMBODIMENT

Figure 1:
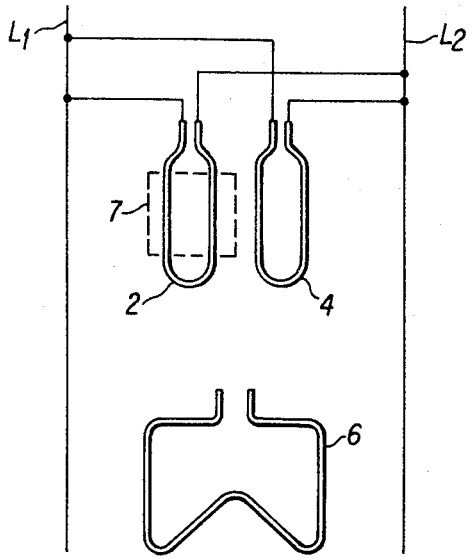

In the drawings, numerals 2 and 4 designate a pair of resistance heating elements referred to herein as broiler elements. In the conventional oven a single resistance heater is employed for broiling whereas the present invention provides for two separate heating elements to be used when broiling. Numeral 6 designates a baking heater element. Ordinarily, the broiler elements are arranged at the top of the oven compartment and the baking element at the bottom thereof. It is desirable that the heat emitted by the broiler heating means be uniformly distributed over the top of the oven and for this reason the two resistance elements 2 and 4 are arranged symmetrically so as to distribute their heat fairly uniformly along the top of the oven compartment. As shown in FIG. 1, the two broiler elements 2 and 4 are connected in parallel across the power lines L1 and L2. For example, the voltage between the lines L1 and L2 may be 240 volts, although a 208 volt voltage difference would be satisfactory. As shown in FIG. 1 also, the heating elements 2 and 4 are connected in parallel whereas the baking element 6 is unconnected or off.

Figure 2:
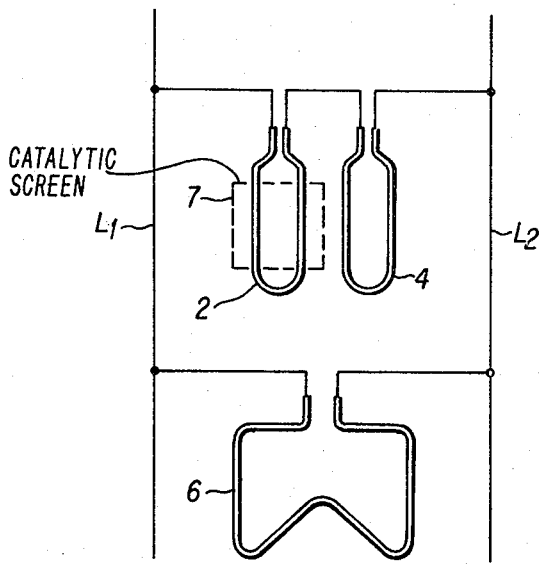
FIG. 2 shows the same elements connected to the power line for baking.

In FIG. 2, the various heating elements of the oven are connected for baking and it is to be noted that the broiler elements 2 and 4 are connected in series between the power lines L1 and L2 and the baking element 6 is in parallel with the broiler elements 2 and 4.

Figure 3:
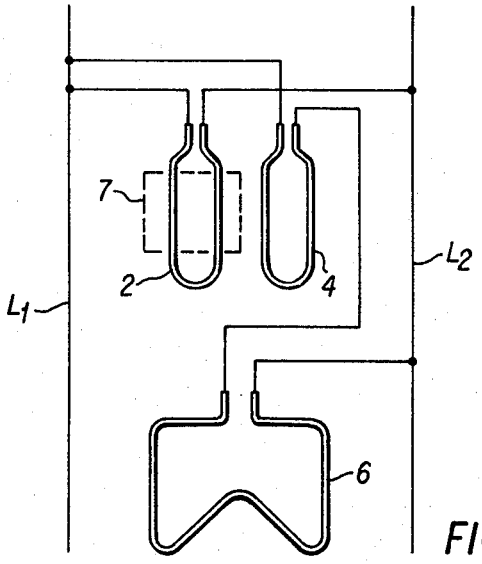
FIG. 3 shows the three elements and the manner of connecting them to the power line for a self-cleaning operation.

In FIG. 3, the baking element 6 is connected in series with broiler element 4 and that series connection extends between the lines L1 and L2. In parallel with that series connection is the broiler element 2, which is connected directly across the power line. The arrangement of FIG. 3 is, as stated, for the purpose of effecting self-cleaning of the oven.

Numeral 7 designates, schematically, a catalytic screen, as commonly provided in self-cleaning ovens, and it is to be noted that the element 2 is positioned adjacent that screen. The screen 7 eliminates any smoke generated during a cleaning cycle and is positioned close to the heater element 2 which is hotter than element 4 during the cleaning cycle.

Figure 4:
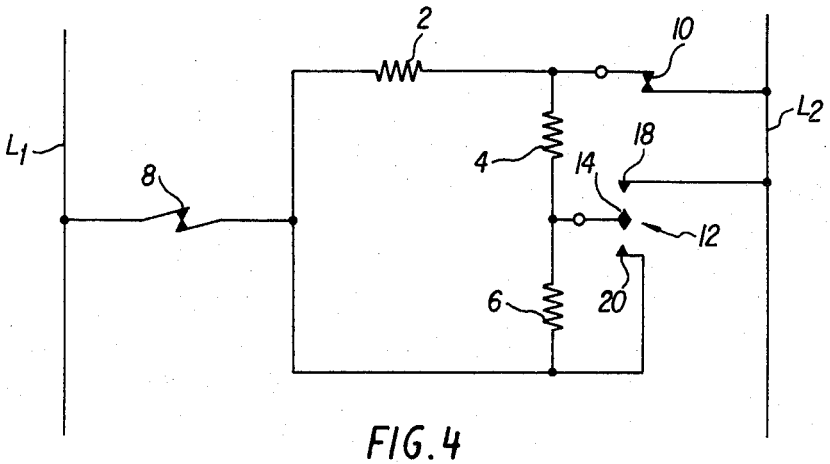
FIG. 4 is a schematic wiring diagram showing a switching arrangement whereby the various elements may be connected in the manners shown in FIGS. 1, 2 and 3.

FIG. 4 is a schematic representation of a wiring diagram suitable for effecting the various connections described with reference to FIGS. 1, 2 and 3. In FIG. 4, L1 and L2 designate the same power lines as in FIGS. 1 to 3 of, for example, 240 volts. Numeral 8 designates an intermittently operable switch controlled by a suitable thermally responsive thermostat (not shown) to close the circuits through the heating elements as necessary to maintain a desired temperature in the oven. It is to be understood that other control devices, common to ovens of the self-cleaning type, will also be provided but are not shown herein since they do not involve the novelty of the present invention. A first on-off switch 10 may be opened or closed and a second double throw switch 12 is also provided, with a central contact 14 connected to a junction between resistance elements 4 and 6. The central contact 14 may be engaged with a contact 18 for direct connection to line L2 or to a contact 20 for connection to one end of the baking heater means and the line L1. Throughout the following description it will be assumed that the switch 8 is closed. With the switches in the condition shown in FIG. 3, it is to be noted that broiler element 2 is connected directly across the power lines and in parallel with the series connection of heater elements 4 and 6, that series connection also being connected to the power lines L1 and L2 in parallel with the heater element 2. This arrangement is as shown in FIG. 3 of the drawings and is employed for self-cleaning. To effect the broiling connections shown in FIG. 1, contact 14 is kept free of contact 18 but is engaged with contact 20. Switch 10 is in the closed position and thus the broiler elements 2 and 4 are connected in parallel between the power lines L1 and L2. To effect connections for baking, as shown in FIG. 2, the contact 14 is brought into engagement with contact 18 and switch 10 is opened. Thus, baking element 6 is connected across the power line and in parallel with elements 2 and 4 which are themselves arranged in series between the power lines.

As stated previously, it is also customary to provide a self-cleaning oven with a catalytic element and it is contemplated that the broiler element 2 be located in the oven adjacent the catalytic element commonly used.

By way of example, assume that the voltage across the lines L1 and L2 is 240 volts and that the elements 2 and 4 dissipate 1600 watts of power each when subjected to 240 volts potential difference. Also assume that the baking heater element 6 is of 2600 watts when subjected to 240 volts. With the above parameters, it will be noted that the total broiling wattage, with the parts connected as shown in FIG. 1 is 3200 watts, the total baking wattage is 3400 watts and the total cleaning wattage is 2,575 watts. All of these wattages are produced by the same line voltage. It has also been found that with the above elements the system is acceptable for broiling, baking and cleaning performance even at a 208 volt line voltage with no change in the elements.

From the above description it can be seen that applicant's arrangement provides for a high wattage output when broiling which is an essential for proper broiling of meats or the like. It also provides for moderate top heat during a baking cycle and a low total wattage when cleaning while still giving intense heat adjacent the catalytic screen which is provided for the purpose of eliminating smoke.

While a single specific arrangement has been shown and described herein, the same is merely illustrative of the principles involved and modifications may be made within the scope of the appended claims.

What is claimed is:

1. In an oven having baking and broiling heating means, the improvement comprising:

said broiling heating means comprising a pair of symmetrically arranged electrical heating elements;

said baking heating means comprising a single electrical heating element; and switch means for selectively connecting said broiling heating elements in series and said baking heating element in parallel therewith for baking; for connecting said broiling heating elements in parallel for broiling; and for connecting one of said broiler heating elements in series with said baking heating element to form a series connection and the other of said broiling heating elements in parallel with said series connection for self-cleaning operation of said oven.

2. An oven as defined in claim 1 wherein each of said broiler heating elements is a resistance heater and both are of substantially the same resistance.

3. An oven as defined in claim 1 wherein said other of said broiling heating elements is positioned adjacent a catalytic screen in said oven.

* * * * *